US012728973B2

(12) United States Patent
Hikosaka

(10) Patent No.: US 12,728,973 B2
(45) Date of Patent: Sep. 8, 2026

(54) OUTBOARD MOTOR

(71) Applicant: SUZUKI MOTOR CORPORATION, Hamamatsu (JP)

(72) Inventor: Tomokazu Hikosaka, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 561 days.

(21) Appl. No.: 18/081,385

(22) Filed: Dec. 14, 2022

(65) Prior Publication Data

US 2023/0202635 A1 Jun. 29, 2023

(30) Foreign Application Priority Data

Dec. 23, 2021 (JP) ..... 2021-209507

(51) Int. Cl.
*B63H 20/14* (2006.01)
*B63H 5/10* (2006.01)
*B63H 20/32* (2006.01)

(52) U.S. Cl.
CPC ..... *B63H 20/14* (2013.01); *B63H 20/32* (2013.01); *B63H 2005/106* (2013.01)

(58) Field of Classification Search
CPC ..... B63H 20/14; B63H 20/32; B63H 20/20; B63H 2020/006; B63H 2020/323; B63H 2005/106
See application file for complete search history.

(56) References Cited

U.S. PATENT DOCUMENTS 4,969,370 A * 11/1990 Hayasaka ..... B63H 20/20 384/585
5,310,371 A * 5/1994 Iriono ..... B63H 23/34 440/52
5,403,218 A * 4/1995 Onoue ..... B63H 20/002 192/48.91
5,514,014 A 5/1996 Ogino et al. ..... 440/75
(Continued)

FOREIGN PATENT DOCUMENTS

EP 2612810 A1 * 7/2013 ..... B63H 20/26
JP H07-323892 A 12/1995
(Continued)

OTHER PUBLICATIONS

What's the Difference Between Bearings_ _ Machine Design (Year: 2016).*
(Continued)

*Primary Examiner* — Brian Christopher Delrue
(74) *Attorney, Agent, or Firm* — Stein IP, LLC

(57) ABSTRACT

An outboard motor includes an outer propeller shaft extending in a front-rear direction, an inner propeller shaft extending in the front-rear direction and disposed at an inner peripheral side of the outer propeller shaft, a rear driven gear disposed at a rear side of a drive gear, a front driven gear disposed at a front side of the drive gear, and a case covering
(Continued)

front portions of the outer propeller shaft and the inner propeller shaft, the drive gear, the rear driven gear, and the front driven gear. A first bearing rotatably supporting the outer propeller shaft on the case and configured to receive an axial load acting on the outer propeller shaft in a front direction is provided at an outer peripheral side of the front portion of the outer propeller shaft.

7 Claims, 5 Drawing Sheets

(56) References Cited

U.S. PATENT DOCUMENTS

| | | | | |
|---|---|---|---|---|
| 5,529,520 | A | 6/1996 | Iwashita et al. | 440/66 |
| 5,556,312 | A | 9/1996 | Ogino | 440/75 |
| 5,556,313 | A | 9/1996 | Ogino | 440/75 |
| 5,575,698 | A | 11/1996 | Ogino | 440/75 |
| 5,597,334 | A | 1/1997 | Ogino | 440/75 |
| 5,697,821 | A | 12/1997 | Ogino | 440/80 |
| 5,820,425 | A | 10/1998 | Ogino et al. | 440/78 |
| 9,708,048 | B2 * | 7/2017 | Sugiyama | B63H 20/20 |
| 10,323,721 | B1 * | 6/2019 | Smith | F16H 3/145 |
| 2008/0146095 | A1 * | 6/2008 | Fukuoka | B63H 20/245 440/89 R |
| 2013/0178121 | A1 * | 7/2013 | Sakamoto | B63H 20/26 440/89 A |
| 2016/0137279 | A1 * | 5/2016 | Sugiyama | B63H 20/20 440/75 |

FOREIGN PATENT DOCUMENTS

| | | | | |
|---|---|---|---|---|
| JP | 3424020 | B2 * | 7/2003 | B63H 23/34 |
| JP | 2016-88275 | A | 5/2016 | |
| JP | 2016088275 | A * | 5/2016 | |
| JP | 6764589 | B2 * | 10/2020 | |
| WO | WO-2007020906 | A1 * | 2/2007 | B63H 20/08 |

OTHER PUBLICATIONS

Double_Row_Tapered_Bearing _TDO_Bearings_wayback_capture_18_August_2019.pdf (Year: 2019).*

Double-Row Tapered Roller Bearings—NSK Bearings for Metal Making—Wayback machine Oct. 25, 2021 (Year: 2021).*

Single and Double Row Needle Bearing—Jul. 24, 2021 Wayback Capture (Year: 2021).*

Notice of Reasons for Refusal dated Sep. 2, 2025, issued by the Japanese Patent Office in corresponding application JP 2021-209507.

* cited by examiner

OUTBOARD MOTOR

CROSS-REFERENCE TO RELATED APPLICATIONS

The disclosure of Japanese Patent Application No. 2021-209507 filed on Dec. 23, 2021, including specification, drawings and claims is incorporated herein by reference in its entirety.

TECHNICAL FIELD

The present disclosure relates to an outboard motor for a contra-rotating propeller type.

BACKGROUND ART

A contra-rotating propeller is a propulsion device that generates a propulsive force by rotating two propellers, which are arranged coaxially with each other, in directions opposite to each other, and is widely applied to an outboard motor. Patent Literature 1 below discloses an example of an outboard motor for a contra-rotating propeller type.

FIG. 5 is a cross-sectional view illustrating an inner portion of a lower portion of an outboard motor for a contra-rotating propeller type in the related art. An outboard motor 121 in FIG. 5 has a configuration similar to that of the outboard motor illustrated in FIG. 2 of Patent Literature 1.

The outboard motor 121 is provided with a drive shaft 122 that transmits power of a power source disposed at an upper portion of the outboard motor 121 to the lower portion of the outboard motor 121. The drive shaft 122 extends in an up-down direction, and a drive gear 128 is coupled to a lower end portion of the drive shaft 122.

A lower case 123 is provided at the lower portion of the outboard motor 121, that is, at a portion sinking below a water surface. An outer propeller shaft 124 and an inner propeller shaft 125 are provided at the lower portion of the outboard motor 121. The two propeller shafts 124 and 125 extend in a front-rear direction and are disposed coaxially with each other. The outer propeller shaft 124 is formed in a tubular shape, and the inner propeller shaft 125 is disposed at an inner peripheral side of the outer propeller shaft 124.

A front propeller 126 is mounted to a rear portion of the outer propeller shaft 124, and a front portion of the outer propeller shaft 124 is disposed in the lower case 123. The outer propeller shaft 124 is rotatable supported by the lower case 123 via a bearing 131 disposed at an intermediate portion of the outer propeller shaft 124 in the front-rear direction. A rear driven gear 129 is coupled to a front end portion of the outer propeller shaft 124. The rear driven gear 129 is rotatably supported by the lower case 123 via a bearing 132.

A rear propeller 127 is mounted to a rear portion of the inner propeller shaft 125, and a front portion of the inner propeller shaft 125 is disposed in the lower case 123. The inner propeller shaft 125 is rotatably supported by the outer propeller shaft 124 and the rear driven gear 129 via a bearing 133 disposed at a position slightly rearward of an intermediate portion of the inner propeller shaft 125 in the front-rear direction and a bearing 134 disposed at a front-end-side portion of the inner propeller shaft 125. A front driven gear 130 is coupled to a front end portion of the inner propeller shaft 125. The front driven gear 130 is rotatably supported by the lower case 123 via a bearing 135.

The drive gear 128, the rear driven gear 129, and the front driven gear 130 are bevel gears. The rear driven gear 129 is disposed at a rear side of the drive gear 128, the front driven gear 130 is disposed at a front side of the drive gear 128, and the rear driven gear 129 and the front driven gear 130 mesh with the drive gear 128. When the drive shaft 122 rotates, the outer propeller shaft 124 and the inner propeller shaft 125 rotate in directions opposite to each other. Accordingly, the front propeller 126 and the rear propeller 127 rotate in directions opposite to each other, and a propulsive force of the boat is generated.

Patent Literature 1: JP2016-88275A

In FIG. 5, when the outboard motor 121 is operated to propel the boat forward, an axial load (thrust load) acting on the inner propeller shaft 125 in a front direction is transmitted, via the front driven gear 130, to the bearing 135 supporting the front driven gear 130 on the lower case 123. At this time, an axial load acting on the outer propeller shaft 124 in the front direction is transmitted to the bearing 135 via a stopper 136 that supports the rear driven gear 129 in an axial direction with respect to the outer propeller shaft 124, the rear driven gear 129, the bearing 134 that rotatably supports the inner propeller shaft 125 with respect to the front driven gear 130, the inner propeller shaft 125, and the front driven gear 130. That is, in the outboard motor 121 in the related art, when the boat sails forward, the bearing 135 receives both the axial load acting on the outer propeller shaft 124 in the front direction and the axial load acting on the inner propeller shaft 125 in the front direction.

In the outboard motor 121 in the related art, when the output of the power source of the outboard motor 121 is increased, the axial loads acting on the two propeller shafts 124 and 125 are increased. For this reason, it is necessary to adopt a bearing having a large load capacity as the bearing 135 that receives these axial loads, and to enhance durability of the bearing 135. However, when a large bearing having a large load capacity is to be adopted as the bearing 135, it is necessary to increase a size of the lower case 123 that accommodates the bearing 135. An increase in size of the lower case 123 presents disadvantages such as increasing the resistance of water during sailing, and thus is not preferable.

The present disclosure is made in view of, for example, the above-described problems, and an object of the present disclosure is to provide an outboard motor in which an axial load applied to a bearing in a front direction, which supports a front driven gear on a case of the outboard motor, can be reduced when a boat sails forward.

SUMMARY

In order to solve the above problem, there is provided an outboard motor for a contra-rotating propeller type, including: an outer propeller shaft extending in a front-rear direction and having a tubular shape, to whose rear portion a first propeller is mounted; an inner propeller shaft extending in the front-rear direction and disposed at an inner peripheral side of the outer propeller shaft, to whose rear portion a second propeller is mounted; a rear driven gear disposed at a rear side of a drive gear coupled to a lower end side of a drive shaft extending in an up-down direction, configured to mesh with the drive gear, and coupled to a front end side of the outer propeller shaft; a front driven gear disposed at a front side of the drive gear, configured to mesh with the drive gear, and coupled to a front end side of the inner propeller shaft; and a case covering a front portion of the outer propeller shaft, a front portion of the inner propeller shaft, the drive gear, the rear driven gear, and the front driven gear. A first bearing rotatably supporting the outer propeller shaft on the case and configured to receive an axial load acting on the outer propeller shaft in a front direction is provided at an outer peripheral side of the front portion of the outer propeller shaft.

DESCRIPTION OF EMBODIMENTS

An outboard motor according to an embodiment of the present disclosure is an outboard motor of a counter-rotating propeller type, and includes a drive shaft extending in an up-down direction, and an outer propeller shaft and an inner propeller shaft extending in a front-rear direction. The outer propeller shaft is formed in a tubular shape, and a first propeller is mounted to a rear portion of the outer propeller shaft. The inner propeller shaft is disposed at an inner peripheral side of the outer propeller shaft, and a second propeller is mounted to a rear portion of the inner propeller shaft.

The outboard motor according to the present embodiment includes a gear mechanism that transmits rotation of the drive shaft to the outer propeller shaft and the inner propeller shaft. The gear mechanism includes a drive gear, a rear driven gear, and a front driven gear. The drive gear is coupled to a lower end side of the drive shaft. The rear driven gear is disposed at a rear side of the drive gear and meshes with the drive gear. The rear driven gear is coupled to a front end side of the outer propeller shaft. The front driven gear is disposed at a front side of the drive gear and meshes with the drive gear. The front driven gear is coupled to a front end side of the inner propeller shaft.

The outboard motor according to the present embodiment includes a case that covers a front portion of the outer propeller shaft, a front portion of the inner propeller shaft, the drive gear, the rear driven gear, and the front driven gear.

Further, in the outboard motor according to the present embodiment, a novel bearing, which rotatably supports the outer propeller shaft on the case and receives an axial load acting on the outer propeller shaft in a front direction, is provided at an outer peripheral side of the front portion of the outer propeller shaft.

Figure 5:
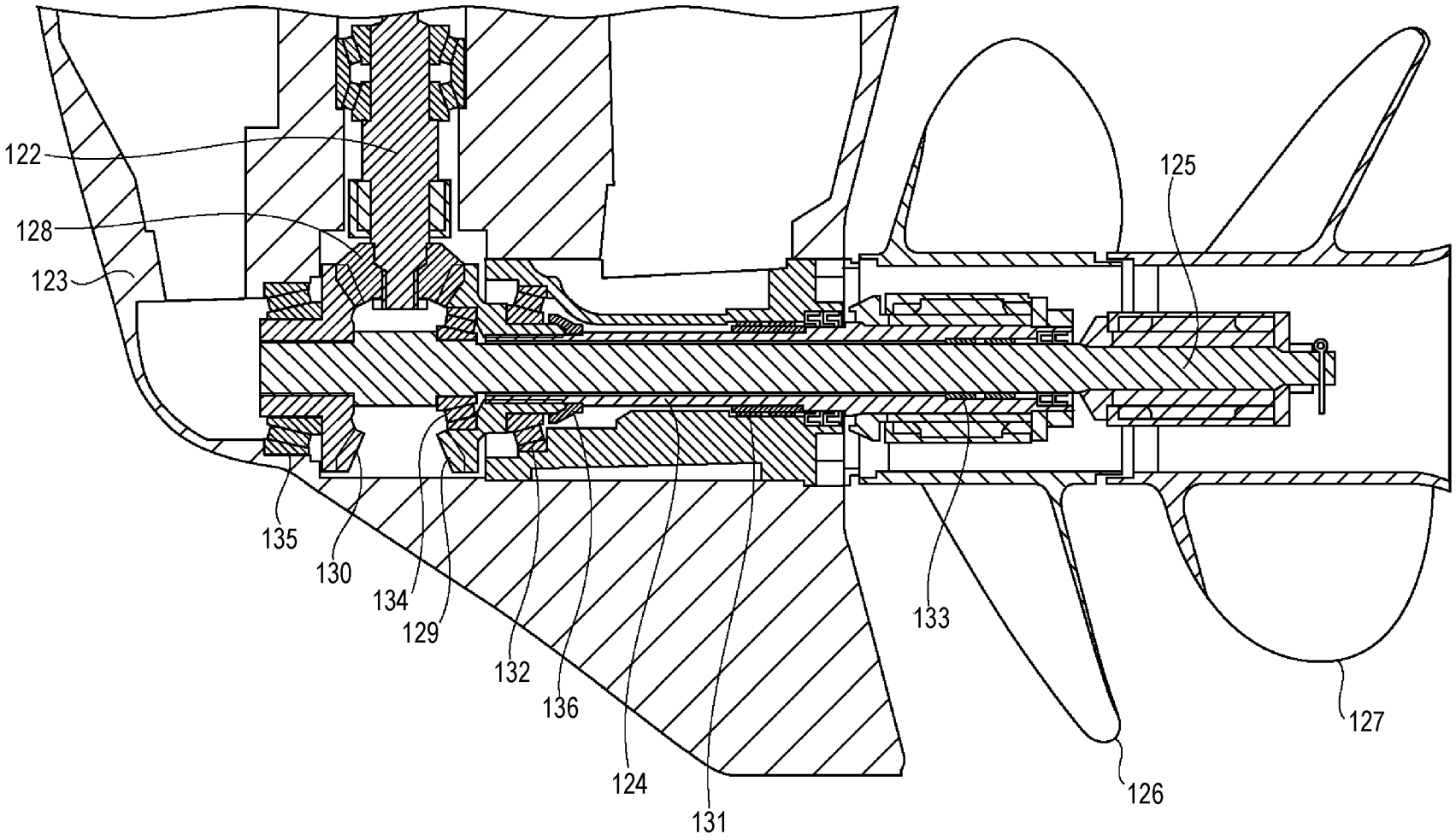
FIG. 5 is a cross-sectional view illustrating an inner portion of a lower portion of an outboard motor in the related art.

According to the outboard motor of the present embodiment, most of the axial load acting on the outer propeller shaft in the front direction when a boat sails forward is received by the novel bearing. Therefore, a situation where the axial load acting on the outer propeller shaft in the front direction when the boat sails forward is applied to a bearing for the front driven gear (a bearing corresponding to the bearing 135 of the outboard motor 121 in the related art illustrated in FIG. 5) that supports the front driven gear on the case, as in the above-described outboard motor in the related art, can be prevented. Therefore, according to the outboard motor of the present embodiment, it is possible to reduce the axial load applied to the bearing for the front driven gear in the front direction when the boat sails forward, as compared with the above-described outboard motor in the related art.

Embodiment

An embodiment of an outboard motor according to the present disclosure will be described. In the embodiment, the directions of up (Ud), down (Dd), front (Fd), rear (Bd), left (Ld), and right (Rd) are indicated by arrows drawn at the lower right of FIGS. 1 to 4.

Figure 1:
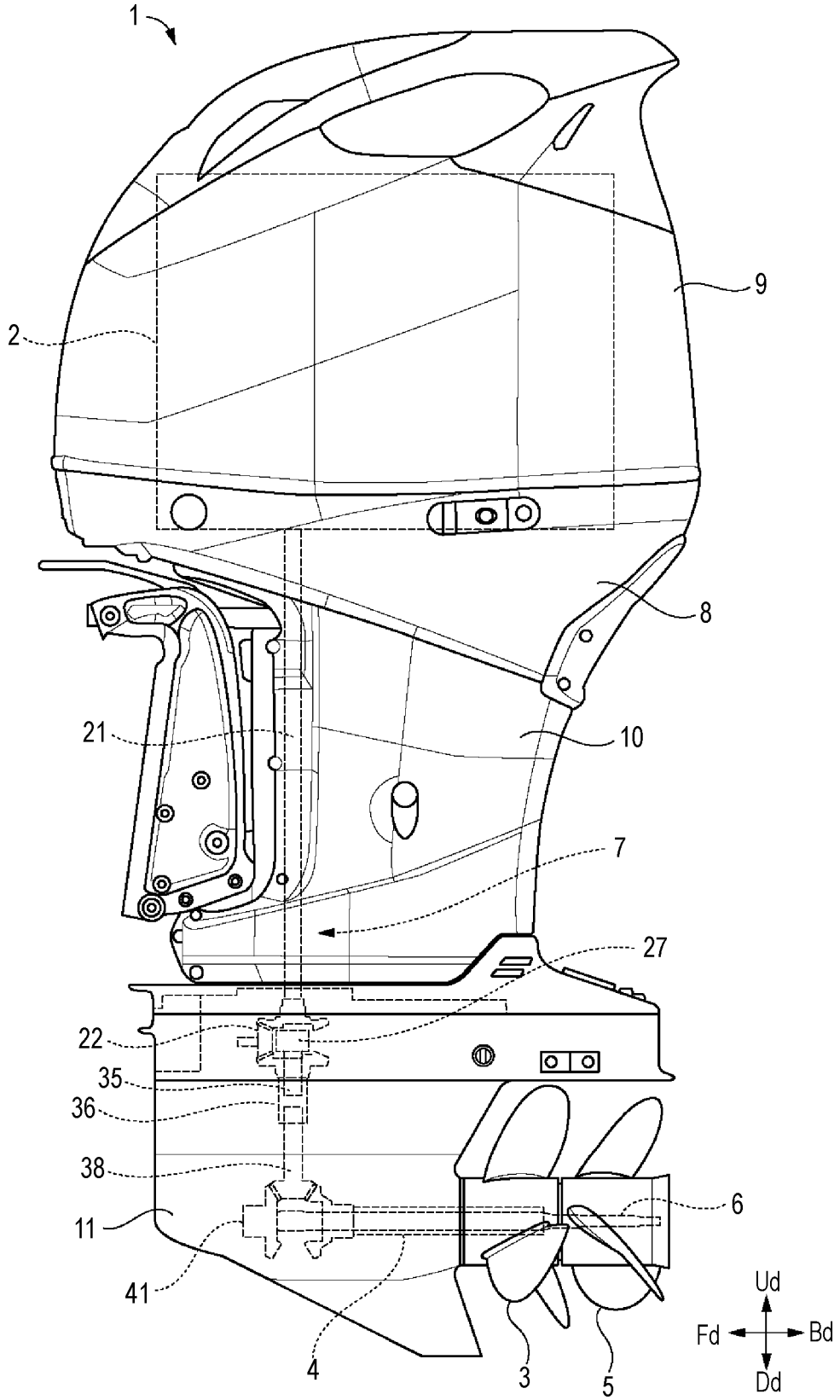
FIG. 1 is an explanatory view illustrating an outboard motor according to an embodiment of the present disclosure as viewed from a left side.

FIG. 1 illustrates an outboard motor 1 according to an embodiment of the present disclosure. As illustrated in FIG. 1, the outboard motor 1 is an outboard motor of a counter-rotating propeller type. The outboard motor 1 includes an engine 2 serving as a power source, a front propeller 3, an outer propeller shaft 4 to which the front propeller 3 is mounted, a rear propeller 5, an inner propeller shaft 6 to which the rear propeller 5 is mounted, and a power transmission mechanism 7 that transmits power of the engine 2 to the propeller shafts 4 and 6. The engine 2 is disposed at an upper portion of the outboard motor 1, the propeller shafts 4 and 6 are disposed at a lower portion of the outboard motor 1, and the power transmission mechanism 7 is disposed between the engine 2 and the propeller shafts 4 and 6. The front propeller 3 is a specific example of a "first propeller", and the rear propeller 5 is a specific example of a "second propeller".

The power transmission mechanism 7 includes an upper drive shaft 21, an upper gear mechanism 22, a clutch 27, an intermediate drive shaft 35, a coupling member 36, a lower drive shaft 38, and a lower gear mechanism 41. The upper drive shaft 21 extends in an up-down direction, an upper end side thereof is connected to the engine 2, and a lower end side thereof enters a lower case 11. The upper drive shaft 21 is rotated in one direction by the power of the engine 2. Hereinafter, the rotation direction of the upper drive shaft 21 is referred to as a forward direction.

The engine 2 is covered with a bottom cowl 8 and a top cowl 9. The upper drive shaft 21 is disposed in an upper case 10. The upper gear mechanism 22, the clutch 27, the intermediate drive shaft 35, the coupling member 36, the lower drive shaft 38, and the lower gear mechanism 41 are disposed in the lower case 11 provided at the lower portion of the outboard motor 1. Front portions of the outer propeller shaft 4 and the inner propeller shaft 6 are disposed in the lower case 11. The lower case 11 is a specific example of a "case".

Figure 2:
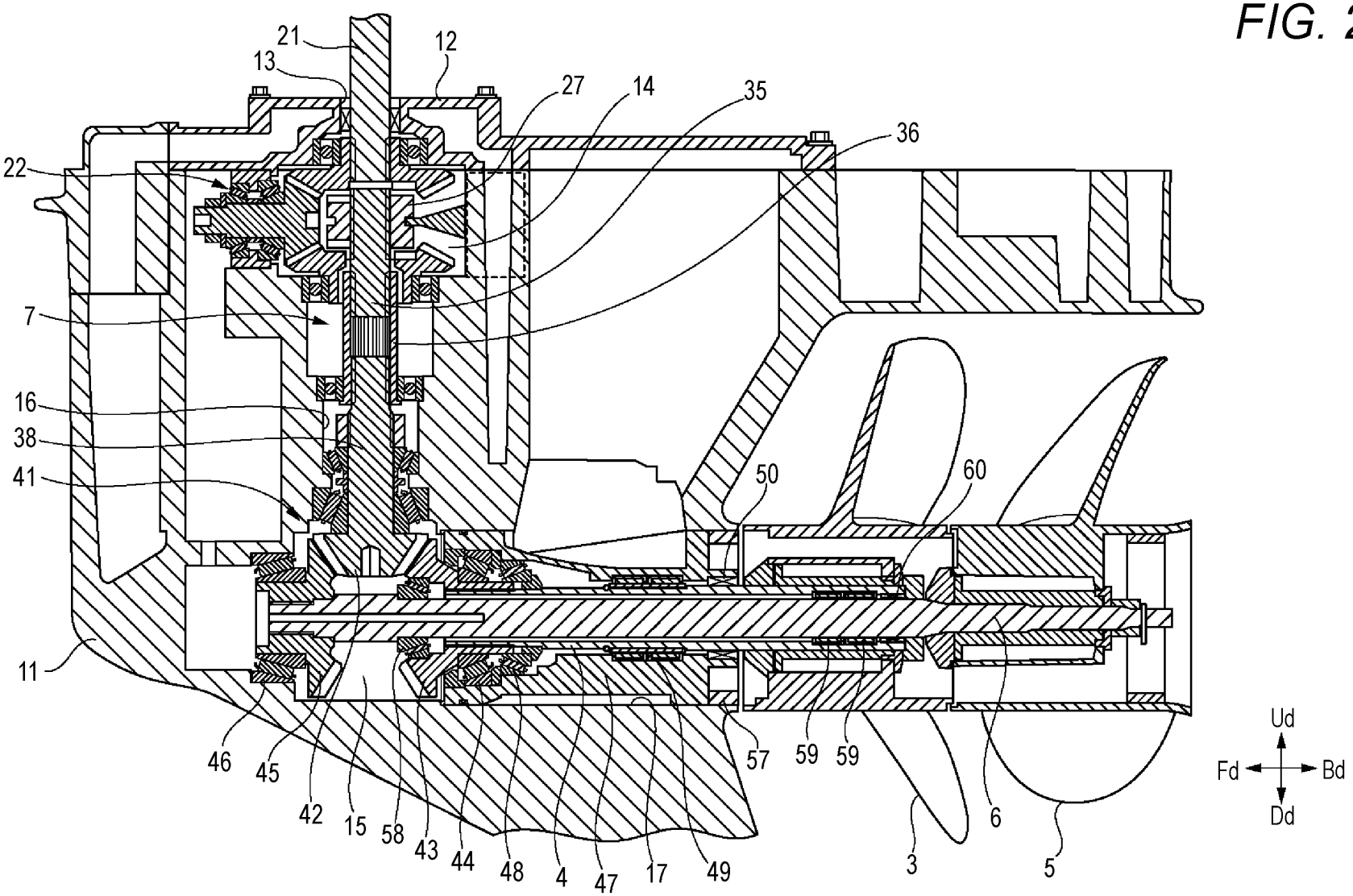
FIG. 2 is a cross-sectional view illustrating an inner portion of a lower portion of the outboard motor according to the embodiment of the present disclosure.
Figure 3:
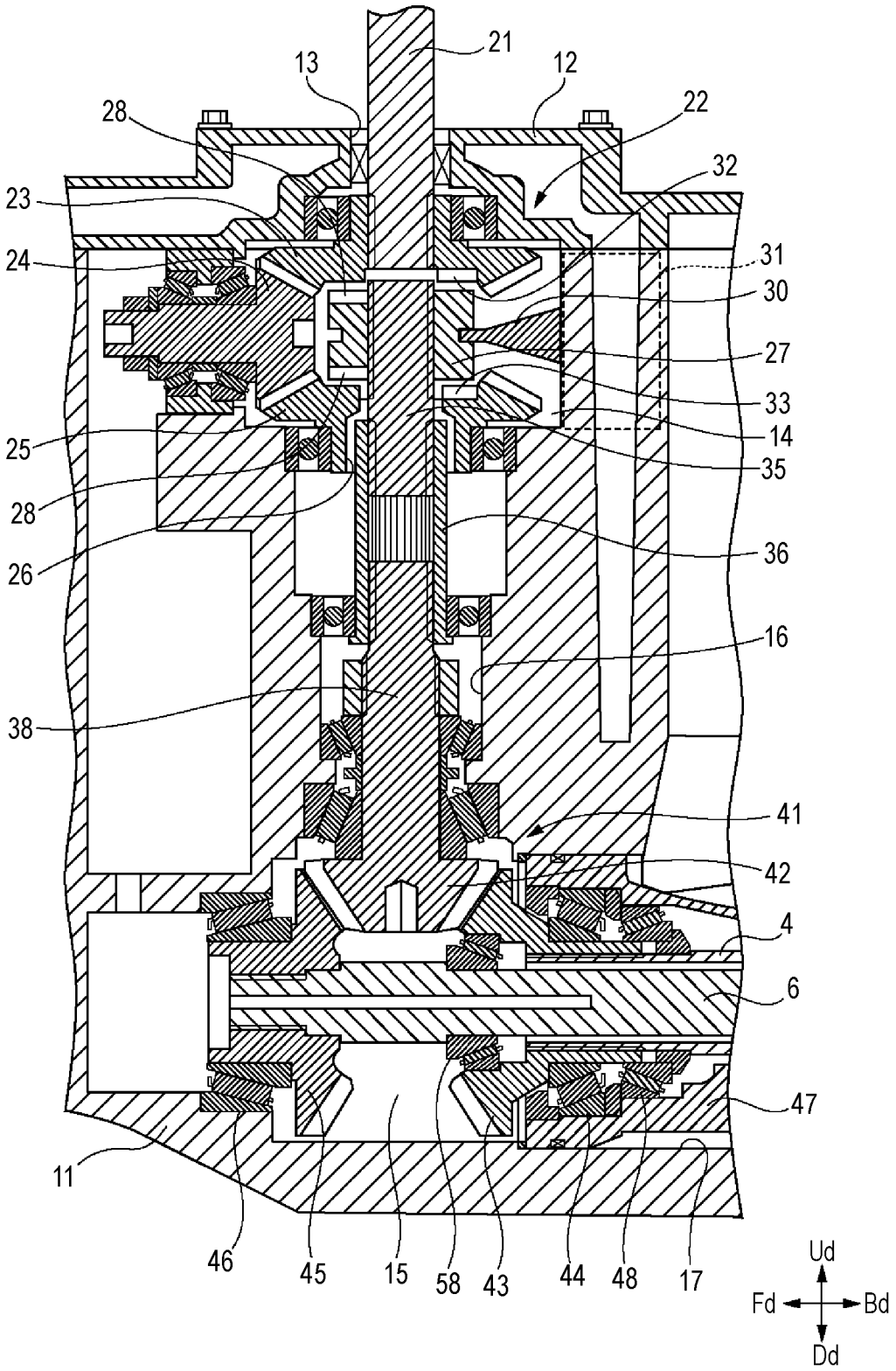
FIG. 3 is an enlarged cross-sectional view of a front portion of a lower case illustrated in FIG. 2.
Figure 4:
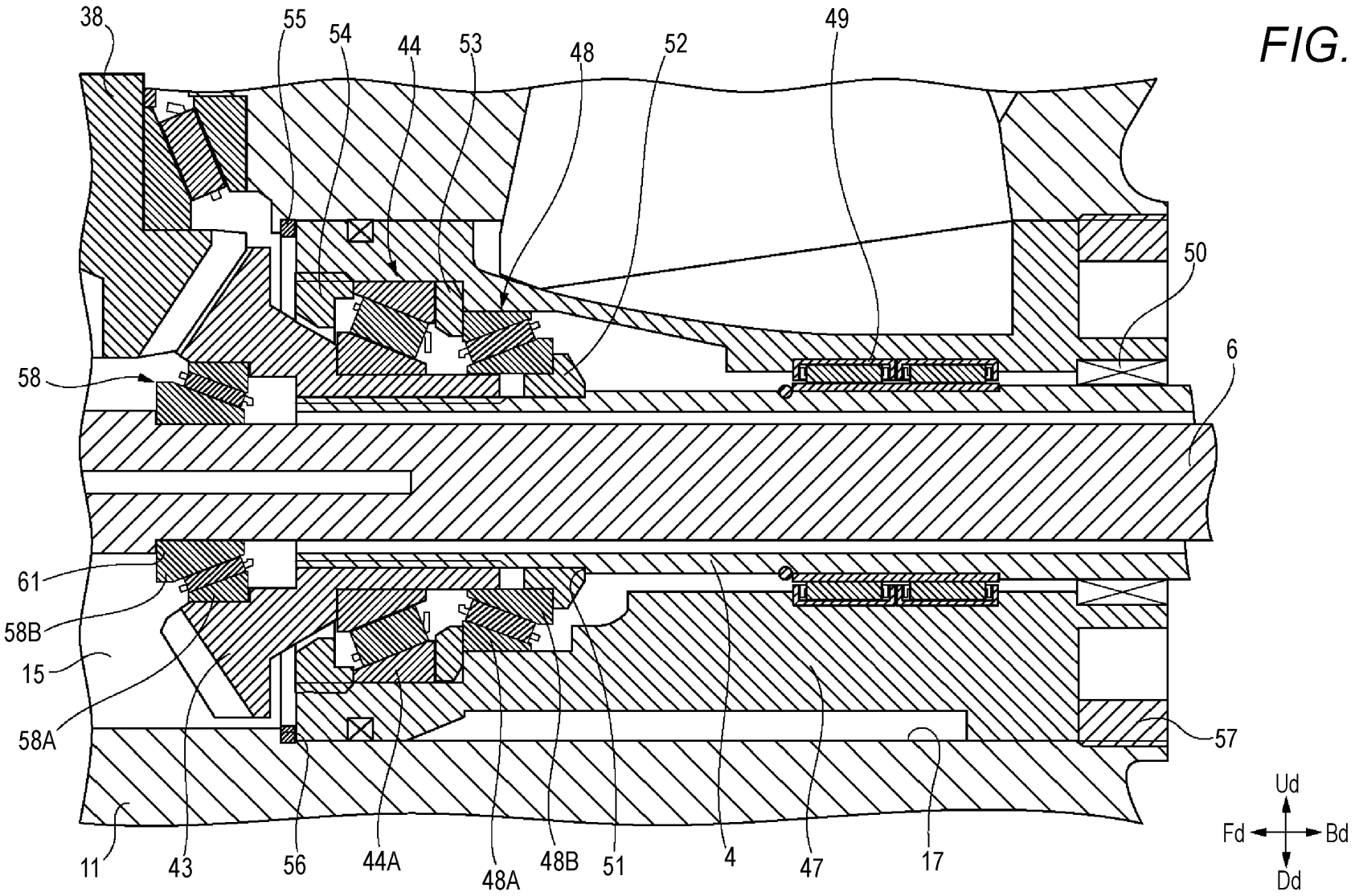
FIG. 4 is an enlarged cross-sectional view of a lower rear portion of the lower case illustrated in FIG. 2.

FIG. 2 illustrates a cross section obtained by cutting components provided at the lower portion of the outboard motor 1 along a plane that extends in a front-rear direction and the up-down direction including shaft centers of the drive shafts 21, 35, 38 and the propeller shafts 4, 6, as viewed from a left side. FIG. 3 illustrates an enlarged view of a front portion of the lower case 11 in FIG. 2. FIG. 4 illustrates an enlarged view of a lower rear portion of the lower case 11 in FIG. 2.

As illustrated in FIG. 2, the lower case 11 is formed in a substantially box shape having an open upper portion, and a lid member 12 that covers a part of the upper portion of the lower case 11 is provided on the upper portion of the lower case 11. A drive shaft insertion hole 13 is formed in the lid member 12. An upper gear chamber 14 is provided at a front upper portion in the lower case 11. The drive shaft insertion hole 13 communicates with the upper gear chamber 14. A lower gear chamber 15 is provided at a front lower portion in the lower case 11. A drive shaft arrangement hole 16 is formed between the upper gear chamber 14 and the lower gear chamber 15 in the lower case 11 to allow the upper gear chamber 14 to communicate with the lower gear chamber 15. A propeller shaft arrangement hole 17 is formed in the lower case 11 at a rear side of the lower gear chamber 15. The propeller shaft arrangement hole 17 communicates with the lower gear chamber 15.

As illustrated in FIG. 3, the upper gear mechanism 22 is disposed in the upper gear chamber 14 of the lower case 11. The upper gear mechanism 22 is a mechanism that generates rotation in a reverse direction with respect to the rotation of the upper drive shaft 21. The upper gear mechanism 22 includes three bevel gears, that is, a reverse drive gear 23, a reverse intermediate gear 24, and a reverse output gear 25. The reverse drive gear 23 is disposed at an upper portion in the upper gear chamber 14 such that a portion where teeth are formed faces downward, and is rotatably supported by the lid member 12. The reverse drive gear 23 is coupled to a lower end portion of the upper drive shaft 21 that enters the upper gear chamber 14 through the drive shaft insertion hole 13, and rotates integrally with the upper drive shaft 21. The reverse intermediate gear 24 is disposed at a front portion in the upper gear chamber 14 such that a portion where teeth are formed faces rearward, and is rotatably supported by the lower case 11. The reverse output gear 25 is disposed at a lower portion in the upper gear chamber 14 such that a portion where teeth are formed faces upward, and is rotatably supported by the lower case 11. The reverse drive gear 23 meshes with the reverse intermediate gear 24, and the reverse intermediate gear 24 meshes with the reverse output gear 25. When the reverse drive gear 23 rotates in the forward direction, the rotation is transmitted to the reverse output gear 25 via the reverse intermediate gear 24, and the reverse output gear 25 rotates in the reverse direction.

The clutch 27 is disposed between the reverse drive gear 23 and the reverse output gear 25. The clutch 27 is a dog clutch and is formed in a cylindrical shape. Clutch pawls 28 are formed on an upper end surface and a lower end surface of the clutch 27, respectively. A through hole 26 is formed in a central portion of the reverse output gear 25, and an upper-end-side portion of the intermediate drive shaft 35 passes through the through hole 26 and enters between the reverse drive gear 23 and the reverse output gear 25. A diameter of the through hole 26 is larger than a diameter of the upper-end-side portion of the intermediate drive shaft 35, and therefore, a gap is formed between the through hole 26 and the upper-end-side portion of the intermediate drive shaft 35. The clutch 27 is coupled to the upper-end-side portion of the intermediate drive shaft 35 so as to be immovable in a circumferential direction but movable in an axial direction with respect to the intermediate drive shaft 35. Accordingly, the clutch 27 and the intermediate drive shaft 35 rotate integrally, and the clutch 27 can move in the up-down direction with respect to the intermediate drive shaft 35.

A shift member 30 connected to the clutch 27 and a clutch control portion 31 that controls movement of the shift member 30 in the up-down direction are provided in the lower case 11. The shift member 30 is connected to the clutch 27 so as to allow the clutch 27 to move in the up-down direction while allowing the clutch 27 to rotate. The clutch 27 can be moved in the up-down direction by moving the shift member 30 in the up-down direction by the clutch control portion 31. When the clutch 27 is moved to an upper side, the clutch pawl 28 formed on the upper end surface of the clutch 27 engages with a clutch pawl 32 formed on a lower end surface of the reverse drive gear 23. Accordingly, the rotation of the upper drive shaft 21 is directly transmitted to the intermediate drive shaft 35, and the intermediate drive shaft 35 rotates in the forward direction. On the other hand, when the clutch 27 is moved to a lower side, the clutch pawl 28 formed on the lower end surface of the clutch 27 engages with a clutch pawl 33 formed on an upper end surface of the reverse output gear 25. Accordingly, rotation of the reverse output gear 25 is transmitted to the intermediate drive shaft 35, and the intermediate drive shaft 35 rotates in the reverse direction.

In the lower case 11, the intermediate drive shaft 35 is disposed in a region covering from an inside of the upper gear chamber 14 to an inside of the drive shaft arrangement hole 16. The lower drive shaft 38 is disposed in the drive shaft arrangement hole 16. Each of the intermediate drive shaft 35 and the lower drive shaft 38 extends in the up-down direction and is disposed coaxially with the upper drive shaft 21. A lower end portion of the intermediate drive shaft 35 and an upper end portion of the lower drive shaft 38 are connected to each other by the coupling member 36, and the intermediate drive shaft 35 and the lower drive shaft 38 rotate integrally. The coupling member 36 and the lower drive shaft 38 are rotatably supported in the drive shaft arrangement hole 16 via bearings. The lower drive shaft 38 is a specific example of a "drive shaft".

The lower gear mechanism 41 is disposed in the lower gear chamber 15 of the lower case 11. The lower gear mechanism 41 is a mechanism that transmits, to the outer propeller shaft 4 and the inner propeller shaft 6, the power of the engine 2 transmitted via the upper drive shaft 21, the upper gear mechanism 22, the clutch 27, the intermediate drive shaft 35, the coupling member 36, and the lower drive shaft 38. The lower gear mechanism 41 includes three bevel gears, that is, a main drive gear 42, a rear driven gear 43, and a front driven gear 45. The main drive gear 42 is a specific example of a "drive gear".

The main drive gear 42 is disposed at an upper portion of the lower gear chamber 15 such that a portion where teeth are formed faces downward. The main drive gear 42 is formed integrally with a lower end portion of the lower drive shaft 38, and rotates integrally with the lower drive shaft 38.

The rear driven gear 43 is disposed at a rear portion of the lower gear chamber 15 such that a portion where teeth are formed faces forward. The rear driven gear 43 is rotatably supported by the lower case 11 via a bearing 44. The rear driven gear 43 is disposed at a rear side of the main drive gear 42 and meshes with the main drive gear 42.

The bearing 44 is, for example, a tapered roller bearing, and is disposed between a boss of the rear driven gear 43 and a bearing housing 47. In addition, the bearing 44 is disposed such that an outer ring raceway surface, an inner ring raceway surface, and a taper apex of rollers in the bearing 44 are located at a rear portion of the bearing 44, and the bearing 44 can receive an axial load acting on the bearing 44 in a rear direction from the rear driven gear 43. The bearing 44 is a specific example of a "third bearing".

The front driven gear 45 is disposed at a front portion of the lower gear chamber 15 such that a portion where teeth are formed faces rearward. The front driven gear 45 is rotatably supported by the lower case 11 via a bearing 46. The front driven gear 45 is disposed at a front side of the main drive gear 42 and meshes with the main drive gear 42.

The bearing 46 is, for example, a tapered roller bearing, and is disposed between a boss of the front driven gear 45 and the lower case 11. In addition, the bearing 46 is disposed such that an outer ring raceway surface, an inner ring raceway surface, and a taper apex of rollers in the bearing 46 are located at a front portion of the bearing 46, and the bearing 46 can receive an axial load acting on the bearing 46 in a front direction from the front driven gear 45.

As illustrated in FIG. 2, the bearing housing 47 is provided in the propeller shaft arrangement hole 17 in the lower case 11. The bearing housing 47 is formed in a tubular shape, is fixed in the lower case 11, and holds the bearing 44 for the rear driven gear 43 and bearings 48 and 49 for the outer propeller shaft 4. Front portions of the outer propeller shaft 4 and the inner propeller shaft 6 are inserted into the propeller shaft arrangement hole 17 at an inner peripheral side of the bearing housing 47.

The outer propeller shaft 4 is formed in a tubular shape and extends in the front-rear direction. The front portion of the outer propeller shaft 4 is supported by the bearing housing 47 via the bearings 48 and 49 so as to be rotatable with respect to the bearing housing 47. The rear driven gear 43 is coupled to a front end portion of the outer propeller shaft 4, and the rear driven gear 43 and the outer propeller shaft 4 rotate integrally. The front propeller 3 is mounted to a rear portion of the outer propeller shaft 4, and the outer propeller shaft 4 and the front propeller 3 rotate integrally. A seal member 50 is provided between the outer propeller shaft 4 and a rear end portion of the bearing housing 47.

The bearing 48 is, for example, a tapered roller bearing. As illustrated in FIG. 4, the bearing 48 is disposed between a front-end-side portion of the outer propeller shaft 4 and the bearing housing 47. In the present embodiment, the bearing 48 is disposed at an outer peripheral side of a rear end portion of the boss of the rear driven gear 43 coupled to the front end portion of the outer propeller shaft 4. The bearing 48 is disposed at a rear side of the bearing 44, which supports the rear driven gear 43 on the bearing housing 47, so as to be adjacent to the bearing 44. In addition, the bearing 48 is disposed such that an outer ring raceway surface, an inner ring raceway surface, and a taper apex of rollers in the bearing 48 are located at a front portion of the bearing 48, and the bearing 48 can receive an axial load that is applied to an inner ring 48B of the bearing 48 from behind toward the front direction. The bearing 48 has a larger load capacity in the axial direction than the bearing 49. The bearing 48 is a specific example of a "first bearing".

A step portion 51 and a rear stopper 52 are provided at an outer peripheral side of the front-end-side portion of the outer propeller shaft 4 as a load transmission mechanism that transmits, to the bearing 48, an axial load acting on the outer propeller shaft 4 in the front direction. The step portion 51 is formed at an outer peripheral portion of the front-end-side portion of the outer propeller shaft 4. The step portion 51 has a front-facing surface, and is provided at a rear side of a portion of the front-end-side portion of the outer propeller shaft 4 to which the rear driven gear 43 is coupled. The rear stopper 52 is formed in an annular shape, and is mounted at the outer peripheral side of the front-end-side portion of the outer propeller shaft 4. The rear stopper 52 is disposed between the step portion 51 and the bearing 48.

A rear end of the rear stopper 52 is in contact with the front-facing surface of the step portion 51, and a rear inner peripheral surface and a rear surface of the inner ring 48B of the bearing 48 are in contact with a front portion of the rear stopper 52. Accordingly, the axial load acting on the outer propeller shaft 4 in the front direction is transmitted to the bearing 48.

A front inner peripheral surface of the inner ring 48B of the bearing 48 is in contact with an outer peripheral surface of the rear end portion of the boss of the rear driven gear 43. A front end of the rear stopper 52 is separated from a rear end of the boss of the rear driven gear 43.

A spacer 53 and a front stopper 54 are provided in the lower case 11 as a bearing support mechanism that supports the bearing 48 so that the bearing 48 is not displaced in the front direction with respect to the lower case 11. In addition, the bearing housing 47 and a step portion 56 formed in the lower case 11 also have a function of supporting the bearing 48 so that the bearing 48 is not displaced in the front direction with respect to the lower case 11, and thus can be considered to be included in constituent elements of the bearing support mechanism.

The spacer 53 is formed in an annular shape, and is disposed between an outer ring 48A of the bearing 48 and an outer ring 44A of the bearing 44 in the bearing housing 47. The front stopper 54 is formed in an annular shape, and is attached to a front end portion of the hearing housing 47. Screws are respectively formed on an outer peripheral surface of the front stopper 54 and an inner peripheral surface of a front end portion of the bearing housing 47. The front stopper 54 is screwed and fixed to the bearing housing 47.

An outer peripheral surface of the outer ring 48A of the bearing 48 is in contact with an inner peripheral surface of the bearing housing 47, and a front surface of the outer ring 48A of the bearing 48 is in contact with a rear surface of the spacer 53. A front surface of the spacer 53 is in contact with a rear surface of the outer ring 44A of the bearing 44, and a front surface of the outer ring 44A of the bearing 44 is in contact with a rear surface of the front stopper 54. Accordingly, the bearing 48 is supported so as not to be displaced in the front direction with respect to the bearing housing 47.

The step portion 56 having a rear-facing surface is formed in the lower case 11 in the vicinity of a boundary between the propeller shaft arrangement hole 17 and the lower gear chamber 15. A front end of the bearing housing 47 is supported by the rear-facing surface of the step portion 56 via a washer shim 55. Accordingly, the bearing housing 47 is supported so as not to be displaced in the front direction with respect to the lower case 11. A rear end of the bearing housing 47 is supported by a fixed member 57 fixed to a rear opening of the propeller shaft arrangement hole 17. The fixed member 57 is formed in an annular shape, and is screwed and fixed to the rear opening of the propeller shaft arrangement hole 17.

The bearing 49 is, for example, a double-row needle bearing, and is disposed between an intermediate portion of the outer propeller shaft 4 in the front-rear direction and the bearing housing 47. The bearing 49 is disposed at a rear side of the bearing 48. The bearing 49 is a specific example of a "second bearing".

As illustrated in FIG. 2, the inner propeller shaft 6 extends in the front-rear direction and is disposed at an inner peripheral side of the outer propeller shaft 4. The inner propeller shaft 6 is disposed coaxially with the outer propeller shaft 4. A front-end-side portion of the inner propeller shaft 6 protrudes to the front side from the outer propeller shaft 4. The front-end-side portion of the inner propeller shaft 6 is supported by the rear driven gear 43 via a bearing 58 so as to be rotatable with respect to the rear driven gear 43. An intermediate portion of the inner propeller shaft 6 in the front-rear direction is supported by the outer propeller shaft 4 via a bearing 59 so as to be rotatable with respect to the outer propeller shaft 4. The front driven gear 45 is coupled to a front end portion of the inner propeller shaft 6, and the front driven gear 45 and the inner propeller shaft 6 rotate integrally. A rear portion of the inner propeller shaft 6 protrudes to the rear side from the outer propeller shaft 4. The rear propeller 5 is mounted to the rear portion of the inner propeller shaft 6, and the inner propeller shaft 6 and the rear propeller 5 rotate integrally. A seal member 60 is provided between the inner propeller shaft 6 and a rear end portion of the outer propeller shaft 4.

The bearing 58 is, for example, a tapered roller bearing, and is disposed between the front-end-side portion of the inner propeller shaft 6 and the rear driven gear 43. In addition, the bearing 58 is disposed such that an outer ring raceway surface, an inner ring raceway surface, and an apex of the taper of the roller in the bearing 58 are located at the rear portion of the bearing 58. As illustrated in FIG. 4, an outer peripheral surface and a rear surface of the outer ring 58A of the hearing 58 are in contact with an inner peripheral portion of the rear driven gear 43. An inner peripheral surface of an inner ring 58B of the bearing 58 is in contact with an outer peripheral surface of the inner propeller shaft 6, and a front surface of the inner ring 58B of the bearing 58 is in contact with a rear-facing surface of the step portion 61 formed on the inner propeller shaft 6.

The bearing 59 is, for example, a needle bearing. As illustrated in FIG. 2, the bearing 59 is disposed between the rear portion of the inner propeller shaft 6 and a rear-end-side portion of the outer propeller shaft 4. In the present embodiment, two single-row needle bearings 59 are provided adjacent to each other, and alternatively, one double-row needle bearing 59 may be provided.

In FIG. 2, when the main drive gear 42 rotates integrally with the lower drive shaft 38, the rotation is transmitted to the rear driven gear 43 and the front driven gear 45. As a result, the outer propeller shaft 4 and the inner propeller shaft 6 rotate. At this time, rotation directions of the outer propeller shaft 4 and the inner propeller shaft 6 are opposite to each other. As the outer propeller shaft 4 and the inner propeller shaft 6 rotate, the front propeller 3 and the rear propeller 5 rotate correspondingly.

When the rotation of the upper drive shaft 21 in the forward direction is transmitted to the outer propeller shaft 4 and the inner propeller shaft 6 via the intermediate drive shaft 35, the lower drive shaft 38, the lower gear mechanism 41, and the like by using the clutch 27, a propulsive force for propelling the boat forward is generated by the front propeller 3 and the rear propeller 5. When the rotation of the reverse output gear 25 in the reverse direction is transmitted to the outer propeller shaft 4 and the inner propeller shaft 6 via the intermediate drive shaft 35, the lower drive shaft 38, the lower gear mechanism 41, and the like by using the clutch 27, a propulsive force for propelling the boat backward is generated by the front propeller 3 and the rear propeller 5.

Further, when the boat sails forward, that is, when a propulsive force for propelling the boat forward is generated by the front propeller 3 and the rear propeller 5, an axial load acts on each of the outer propeller shaft 4 and the inner propeller shaft 6 in the front direction. In FIG. 4, most of the axial load acting on the outer propeller shaft 4 in the front direction is transmitted to the bearing 48 via the step portion 51 of the outer propeller shaft 4 and the rear stopper 52. The bearing 48 is fixed to the bearing housing 47 by the spacer 53, the outer ring 44A of the bearing 44, and the rear stopper 52 so as not to be displaced in the front direction with respect to the bearing housing 47, and the bearing housing 47 is fixed to the lower case 11 by the step portion 56 of the lower case 11 so as not to be displaced in the front direction with respect to the lower case 11. As a result, the bearing 48 receives most of the axial load acting on the outer propeller shaft 4 in the front direction. On the other hand, in FIG. 2, most of the axial load acting on the inner propeller shaft 6 in the front direction is transmitted to the bearing 46 via the front driven gear 45. The bearing 46 receives the most of the axial load acting on the inner propeller shaft 6 in the front direction. As described, in the outboard motor 1, the bearing 48 mainly receives the axial load acting on the outer propeller shaft 4 in the front direction when the boat sails forward, and the bearing 46 mainly receives the axial load acting on the inner propeller shaft 6 in the front direction when the boat sails forward.

As described above, in the outboard motor 1 according to the embodiment of the present disclosure, the bearing 48 that rotatably supports the outer propeller shaft 4 on the bearing housing 47 fixed to the lower case 11 and receives the axial load acting on the outer propeller shaft 4 in the front direction is provided at the outer peripheral side of the front-end-side portion of the outer propeller shaft 4. With this configuration, most of the axial load acting on the outer propeller shaft 4 in the front direction when the boat sails forward can be received by the bearing 48. Therefore, it is possible to prevent the axial load acting on the outer propeller shaft 4 in the front direction when the boat sails forward from being applied to the bearing 46 that supports the front driven gear 45 on the lower case 11. Therefore, the axial load applied to the bearing 46 in the front direction when the boat sails forward can be reduced as compared with that in the described outboard motor in the related art. Therefore, in comparison with the outboard motor in the related art, a small bearing having a small load capacity can be adopted as the bearing 46, and a size of the lower case 11 accommodating the bearing 46 can be reduced. Further, in comparison with the outboard motor in the related art, the output of the power source of the outboard motor 1 can be increased without adopting a large bearing having a large load capacity as the bearing 46. Therefore, it is possible to prevent an increase in size of the lower case 11 due to an increase in the output of the power source of the outboard motor 1, and it is possible to implement the outboard motor 1 having a small size and a high output.

In the outboard motor 1 according to the present embodiment, the step portion 51 and the rear stopper 52 are provided at the outer peripheral side of the front-end-side portion of the outer propeller shaft 4 as a load transmission mechanism that transmits, to the bearing 48, an axial load acting on the outer propeller shaft 4 in the front direction. The spacer 53 and the front stopper 54 are provided in the lower case 11 as a bearing support mechanism that supports the bearing 48 so that the bearing 48 is not displaced in the front direction with respect to the lower case 11. With these configurations, a structure in which the bearing 48 receives the axial load acting on the outer propeller shaft 4 in the front direction when the boat sails forward can be compactly formed without significantly expanding a component accommodating space in the lower case 11. Therefore, it is possible to prevent an increase in size of the lower case 11.

In the outboard motor 1 according to the present embodiment, the bearing 48 is disposed at an outer peripheral side of the boss of the rear driven gear 43. With this configuration, in the lower case 11, a space for disposing the bearing 48 can be easily created by slightly expanding a space in which the bearing 44 that supports the rear driven gear 43 on the bearing housing 47 is disposed. Therefore, the bearing 48 can be provided in the lower case 11 while preventing an increase in size of the lower case 11.

In the outboard motor 1 according to the present embodiment, the bearing 48 is disposed at the rear side of the bearing 44, which supports the rear driven gear 43 on the bearing housing 47, so as to be adjacent to the bearing 44. With this configuration as well, in the lower case 11, the space for disposing the bearing 48 can be easily created by slightly expanding the space, in which the bearing 44 is disposed, to the rear side, and the bearing 48 can be provided in the lower case 11 while preventing an increase in size of the lower case 11.

Further, in the outboard motor 1 according to the present embodiment, the bearing 49 that rotatably supports the outer propeller shaft 4 on the bearing housing 47 fixed to the lower case 11 is provided at the outer peripheral side of the outer propeller shaft 4, at the rear side of the bearing 48. According to this configuration, the outer propeller shaft 4 can be supported on the bearing housing 47 at two positions separated from each other in the front-rear direction by the bearing 48 and the bearing 49. Therefore, shaft runout of the propeller shafts 4 and 6 can be prevented, and vibration during operation of the outboard motor 1 can be reduced.

In the outboard motor 1 according to the present embodiment, the bearing 48 has a larger load capacity in the axial direction than the bearing 49. Accordingly, durability of the bearing 48 that receives most of the axial load acting on the outer propeller shaft 4 in the front direction when the boat sails forward can be improved, and the life of the bearing 48 can be extended.

In the above embodiment, the example is described in which the bearing 48 that receives most of the axial load acting on the outer propeller shaft 4 in the front direction when the boat sails forward is disposed at the outer peripheral side of the boss of the rear driven gear 43. Alternatively, the bearing 48 may be disposed at the rear side of the boss of the rear driven gear 43. In the above embodiment, the bearing 48 is disposed adjacent to the bearing 44. Alternatively, the bearing 48 may be disposed away from the bearing 44.

In the above embodiment, the example is described in which the rear stopper 52 is provided ant the inner ring 48B of the bearing 48 is brought into contact with the rear stopper 5. Alternatively, the rear stopper 52 may be omitted, and the inner ring 48B of the bearing 48 may be brought into contact with the step portion 51 of the outer propeller shaft 4.

In the above embodiment, the example is described in which the spacer 53 and the front stopper 54 are provided and are used to support the bearing 48 so that the bearing 48 is not displaced in the front direction with respect to the bearing housing 47. Alternatively, the bearing housing 47 may be formed with a step portion having rear-facing surface and the outer ring 48A of the bearing 48 may be brought into contact with the rear-facing surface of the step portion, whereby the bearing 48 is supported so as not to be displaced in the front direction with respect to the bearing housing 47.

The present disclosure can be modified as appropriate without departing from the gist or idea of the disclosure which can be read from the claims and the entire specification, and the outboard motor to which this modification is applied is also included in the technical idea of the present disclosure.

What is claimed is:

1. An outboard motor for a contra-rotating propeller type, comprising:

an outer propeller shaft extending in a front-rear direction and having a tubular shape, to whose rear portion a first propeller is mounted;

an inner propeller shaft extending in the front-rear direction and disposed at an inner peripheral side of the outer propeller shaft, to whose rear portion a second propeller is mounted;

a rear driven gear disposed at a rear side of a drive gear coupled to a lower end side of a drive shaft extending in an up-down direction, configured to mesh with the drive gear, and coupled to a front end side of the outer propeller shaft;

a front driven gear disposed at a front side of the drive gear, configured to mesh with the drive gear, and coupled to a front end side of the inner propeller shaft; and a case covering a front portion of the outer propeller shaft, a front portion of the inner propeller shaft, the drive gear, the rear driven gear, and the front driven gear, wherein a first bearing rotatably supporting the outer propeller shaft on the case and configured to receive an axial load acting on the outer propeller shaft in a front direction from the first bearing toward the rear driven gear is provided at an outer peripheral side of the front portion of the outer propeller shaft, and wherein the first bearing is disposed at a rear side of a third bearing so as to be adjacent to the third bearing, the third bearing rotatably supporting the rear driven gear on the case.

2. The outboard motor according to claim 1, wherein the first bearing is disposed between the front portion of the outer propeller shaft and the case, wherein a load transmission mechanism configured to transmit the axial load acting on the outer propeller shaft in the front direction to the first bearing is provided at the outer peripheral side of the front portion of the outer propeller shaft, and wherein a bearing support mechanism supporting the first bearing so that the first bearing is not displaced in the front direction with respect to the case is provided at the case.

3. The outboard motor according to claim 1, wherein the first bearing is disposed at an outer peripheral side of the rear driven gear or at a rear side of the rear driven gear.

4. The outboard motor according to claim 1, wherein a second bearing rotatably supporting the outer propeller shaft on the case is provided at an outer peripheral side of the outer propeller shaft and at a rear side of the first bearing.

5. The outboard motor according to claim 4, wherein the first bearing has a larger load capacity in an axial direction than the second bearing.

6. The outboard motor according to claim 1, wherein the third bearing is configured to receive an axial load acting on the third bearing in a rear direction from the rear driven gear.

7. The outboard motor according to claim 4, wherein the second bearing is a double-row needle bearing.

* * * * *